US007024803B2

(12) United States Patent
Basso

(10) Patent No.: US 7,024,803 B2
(45) Date of Patent: Apr. 11, 2006

(54) STRATIFIED INSOLE FOR THE INTERNAL VENTILATION AND CONTROL OF THE MICROCLIMATE OF A SHOE

(75) Inventor: Angelo Basso, Montebelluna (IT)

(73) Assignee: Calzaturifico Corilus Srl, Treviso (IT)

( * ) Notice: Subject to any disclaimer, the term of this patent is extended or adjusted under 35 U.S.C. 154(b) by 213 days.

(21) Appl. No.: 10/799,584

(22) Filed: Mar. 15, 2004

(65) Prior Publication Data

US 2005/0198859 A1 Sep. 15, 2005

(51) Int. Cl.
*A43B 7/06* (2006.01)
*A43B 7/08* (2006.01)
*A43B 13/20* (2006.01)

(52) U.S. Cl. ..... 36/3 B; 36/44; 36/141

(58) Field of Classification Search ..... 36/44, 36/3 R, 3 B, 141, 29
See application file for complete search history.

(56) References Cited

U.S. PATENT DOCUMENTS

| | | | | |
|---|---|---|---|---|
| 2,253,959 | A * | 8/1941 | Margolin | 36/3 B |
| 3,624,930 | A * | 12/1971 | Johnson et al. | 36/3 B |
| 4,798,009 | A * | 1/1989 | Colonel et al. | 36/28 |
| 4,910,882 | A * | 3/1990 | Goller | 36/3 B |
| 4,939,851 | A * | 7/1990 | Miller | 36/3 B |
| D389,996 | S * | 2/1998 | Sessa | D2/961 |
| 5,815,949 | A * | 10/1998 | Sessa | 36/3 B |
| 6,185,844 | B1 * | 2/2001 | Janzen | 36/3 B |
| 6,305,100 | B1 | 10/2001 | Komarnycky et al. | |
| 6,408,541 | B1 | 6/2002 | Moretti | |
| 6,701,640 | B1 * | 3/2004 | Nakano | 36/3 B |
| 2005/0138838 | A1 * | 6/2005 | Lin et al. | 36/3 B |

FOREIGN PATENT DOCUMENTS

| | | |
|---|---|---|
| DE | 197115097 | 11/1997 |
| EP | 0437869 A2 * | 7/1991 |
| GB | 2247391 | 3/1992 |
| GB | 2250417 | 6/1992 |

* cited by examiner

*Primary Examiner*—Anthony Stashick
(74) *Attorney, Agent, or Firm*—Egbert Law Offices

(57) ABSTRACT

A stratified insole for the internal ventilation and the control of the microclimate of a shoe of the type including a sole, if necessary provided with holes intercommunicating with the inside of the shoe, in correspondence with the internal side of which a ventilated stratified insole is joined. The insole is composed of at least one layer of thermoplastic material whose upper interface is shaped with a plurality of channels and is positioned above the upper part of a layer of transpiring material for the support of the sole of the foot. The insole is peripherally shaped according to the shape of the sole of the foot and is obtained by connecting a first layer made from transpiring rigid or semi-rigid material, a second layer made from insulating material, a third layer made from insulating material, and a fourth layer made from transpiring material.

7 Claims, 2 Drawing Sheets

STRATIFIED INSOLE FOR THE INTERNAL VENTILATION AND CONTROL OF THE MICROCLIMATE OF A SHOE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This invention refers to a stratified insole for the internal ventilation and control of the microclimate of a shoe.

The invention finds particular if not exclusive application in the field of the production and marketing of sporting footwear.

BACKGROUND OF THE INVENTION

As a rule, a conventional shoe is composed of an upper, or rather an external covering, and a sole to which said upper is to be joined. This type of operation must provide the use of an insole, peripheral to which the edge of the upper is turned-up and therefore stably fixed, for example by means of gluing. Traditional insoles, for instance, can be rigid or soft and are made up of a flat surface in certain anatomical cases, and moreover are provided with a containment structure that peripherally duplicates the shape of the sole of the foot.

In the case of a sporting shoe, vice versa, a rigid insole is not generally used, but rather provision is only made for the interposition of a layer of material insert or fubbett covered with the fabric to be placed on the inside of the housing defined by a sole provided peripherally with a side, or alternatively, providing the integration of a layer of soft material of the shock absorber type in the sole, to then finally join the upper to said sole according to usual techniques.

A process is also known for producing footwear that provides a sole or a stratified insert that is obtained by joining single layers of material on top of each other, often with different technical specifications to each other. The same applicant proposed a first teaching, which had as an object an insole sewn onto the upper or of the removable type. As stated by the redactor, in essence, the suggestion consists in the connection of three insoles (inserts) of which the first is a rubbery elastic material, the second is special material with high elasticity and recall and finally the third material is leather. The insole manufactured in this way, that is to say layered, is mainly proposed as an integrating element of a normal light shoe, in which the layer of leather forms the sole and is sewn directly to the upper. Among the applications, an insert with a high level of elasticity and comfort is provided that is to be introduced into a normal shoe, or alternatively as an insert to be sewn directly to the upper for light, relaxation, sporting or driving footwear.

Among the most common drawbacks of conventional footwear is the fact that adequate acclimatizing is not permitted, above all in the support area of the sole of the foot. This circumstance, as is already known, determines the onset of excessive sweating with the frequent formation of unpleasant odours. Also, it should not be forgotten that the inadequate ventilation of the foot, together with the effect of sweating permits the proliferation of micro-bacteria and fungus, a rather common problem that is not easily resolved. Finally, also due to the effect of a lack of ventilation, insufficient comfort is observed, which causes the phenomenon of steamchill.

The companies in this sector have, therefore, for some time being orientated in this direction, with the main object of finding innovative solutions and often improved solutions from the technical point of view, with reference to pre-existing solutions.

PRIOR ART

IT1288658 (Basso) suggests a shoe, which includes an acclimatized technical sole structure in which the upper is associated to a sole prior to the interposing of a stratified insole, in which at least one layer is treated with hygienic anti-mould and anti-bacterial products, said insole being obtained by means of the association of a first thermoplastic material layer whose shape forms channels and to which a second layer is associated, made up of a layer of coconut fibre to then finally a third element is provided made up of a shape in leather; and in which the sole, in logical correspondence, provides intercommunicating holes with the exterior facilitating the circulation of air across the said insole.

A ventilated insole is also described in GB2250417 (Chao). The proposal provides an upper layer and a lower layer made from foam material, where the lower layer and the upper layer are joined to each other by adhesive and are cut according to the shape of a shoe. The adhesive surface, in correspondence to the lower layer, presents longitudinal and transversal connection furrows which extend from the edge of the lower layer to the posterior part of the lower layer. In correspondence to the end of the furrows of the layered insole, recesses are also obtained in order to avoid the obstruction of the ends of furrows by contact with the edge of the interior wall of the sole, in this way allowing the correct evacuation of the air. The posterior part of the insole is elongated and lies in a position close to the opening of the shoe in such a way as to avoid the obstruction by the internal walls of the shoe, ensuring ventilation. The upper layer can be obtained with a series of circular holes in correspondence to the underlying furrows of the lower layer in order to make the ventilation passing system more efficient.

U.S. Pat. No. 6,305,100 (Komarnycky et. al.) also proposes a ventilated shoe. In this case, the ventilation of the internal area of the shoe and its surrounding development is to be simplified. An air cavity allows the heat and the humidity to escape from the immediate area of the foot and to be evacuated into a free open space. A stratified sole system of the type with two layers is integrated in such a way as to form an air cavity with which there is interaction. A plurality of openings and outward recesses are provided to facilitate the ventilation of the foot and to expel the flow of humidity. Furthermore, a plurality of accesses are utilized to facilitate bi-directional exchange and circulation.

The following Patent Application DE19715097 (Usui et al.) provides sole elements, obtained in block copolymers according to the sequence A-B-A where A is styrene.

The American patent U.S. Pat. No. 6,408,541 (Polegato), describes a sole for a micro-ventilated shoe. The structure of the sole provides an external sole, a rigid insert and layers connected with holes. The holes of the second layer are in exact communication with the channels of the external sole. The document in question does not illustrate any channel typology.

The English Patent Application GB2247391 (Clive) describes a sole for a micro-ventilated shoe. Also in this case, the construction of the sole provides an external sole, a rigid insert and connected layers with holes. The holes of the second layer are in exact communication with the channels of the external sole. The document in question does not illustrate any rigid inset.

DRAWBACKS

The aforementioned solutions, as they are also significant under the profile of improving the general comfort of the shoe, according to applicant, do not solve the problem of ventilation in an optimal way. On the other hand, the insulating function seems neglected, as the issue of the microclimate that the sole ventilation in itself modifies is not confronted in a specific way.

In more detail IT1288658 (Basso) provides a stratified insole with a first layer of thermoplastic material in correspondence to a facade of the longitudinal channels, due to the fact that it provides an upper layer of coconut fibre it seems not to favour in a correct way the longitudinal passage of the airflow that passes along each channel. From a practical point of view, it seems that the cause refers to the layer of coconut fibre material, that over time, tends to flake, yielding with the lower part, a circumstance that seems to obstruct the aforementioned ventilating channels obtained in the thermoplastic lower layer. In this way the air circulation appears to be compromised. Secondly, due to this second layer of coconut fibre material, that on the other hand is not even specially adapted for the hygienics needed to constitute a good bacteria receptacle, the airflow does not reach the necessary velocity to be carried adequately towards the sole of the foot, but tends to disperse excessively because it would involve the whole surface of the second layer.

The insole proposed in GB2250417 (Chao), seems not to confer a good insulating function, this is due to the fact that the sole of the foot is in direct contact with the layer of thermoformed material that provides the holes through which the air circulates. The sole of the foot, in this way, tends to be excessively cool above all in adverse climatic conditions, such as low temperatures, rain and humidity. This is followed by an unpleasant feeling that to a large degree confers to the shoe, under the profile of comfort, a negative overall evaluation.

U.S. Pat. No. 6,305,100 (Komarnycky et. to the.), proposes a ventilated shoe that requires a specific working above all in correspondence to the sole. From a practical point of view, the construction is rather complex, is limited to certain footwear typologies and seems to compromise the suitable ventilation of the foot due to the fact that the openings obtained peripherally to the sole can cause obstruction due to their proximity with the support surface. A further negative aspect is caused by the fact that on the interior of the central cavity, obtained in correspondence to the upper side of the sole, the cushion of air that is formed, even if temporarily, constitutes a good conductor element due to the presence of water particles, thus transferring the climatic variations to the overlying surface of the sole of the foot. The presence of only the holed insole, in fact, seems to be insufficient to allow a good insulating function.

Therefore, there is a need to determine solutions to make improvements with respect to the prior art.

The aim of this invention is also to avoid the above-mentioned drawbacks.

BRIEF SUMMARY OF THE INVENTION

This and other aims are achieved with this invention according to the characteristics as in the included claims by means of a stratified insole for the internal ventilation and the control of the microclimate of a shoe of the type including a sole, if necessary provided with holes intercommunicating with the inside of the shoe, in correspondence with the internal side of which a ventilated stratified insole is joined that is composed of at least one layer of thermoplastic material whose upper interface is shaped with a plurality of channels and is positioned above the upper part of a layer of transpiring material for the support of the sole of the foot; said insole peripherally shaped according to the shape of the sole of the foot is obtained by connecting the following layers of material one above the other:

A first lower support layer made from transpiring rigid or semi-rigid material;

A second layer, superimposed on said first layer, made from insulating material, which provides a plurality of channels, in correspondence to the upper interface, that develop longitudinally from the anterior part to the posterior part of said layer, if necessary involved by transverse connecting channels;

A third layer superimposed on said second layer, made in insulating material, that provides a plurality of channels, in correspondence with the upper interface, at least partly coinciding with the channels obtained along the second layer which develop longitudinally from the anterior part to the posterior part of said layer, if necessary involved by transverse connecting channels, said channels of the third layer being in intercommunication with the channels of the underlying layer; and A fourth layer of material joined to said third layer, made from transpiring material.

AIMS

In this way, by means of the considerable creative contribution the effect of which constitutes immediate technical progress, the following aims are achieved all substantially extended to increase comfort.

A first aim intends to improve the ventilation of the area where the foot is to be housed, above all with reference to the sole, that due to the effect of the correct distribution of the airflow will benefit from a reduction of the exudative phenomenon with less bacteria proliferation and a definite elimination of the probabilities of the onset of unpleasant odours.

A second aim was that of allowing, on the internal housing of the shoe, the ideal microclimate for the foot to be achieved and maintained. It was possible to achieve the aim because of the combination, in the insole, of the layers of insulating material that allow the area above the sole to be thermally insulated, while the ventilation function participates in evacuating the formation of condensation.

In conclusion, it was possible to obtain a valuable product with good technological content for the company, improving considerably the offer on the market with the containment of production costs.

These and others advantages will appear from the following specific description of a preferred embodiment with the aid of the enclosed schematic drawings, whose details are not to be considered restrictive but only illustrative.

DETAILED DESCRIPTION OF THE INVENTION

With reference also to the Figures, it is observed that the shoe is of the type including a sole 1, obtained for example, in thermoplastic material, polyurethane, rubber or EVA, or even leather, where in this particular case the upper part is delimited by a perimetric side 10, defining in this way a seat to house a stratified insole A or B. Also, said sole 1 if necessary provides holes 11 that allow the environment inside the shoe to intercommunicate with the exterior. In one variant, it is possible to superimpose to a limited degree a membrane on the surface involved by the holes 11 that allows perspiration but not permeation by water.

Figure 3:
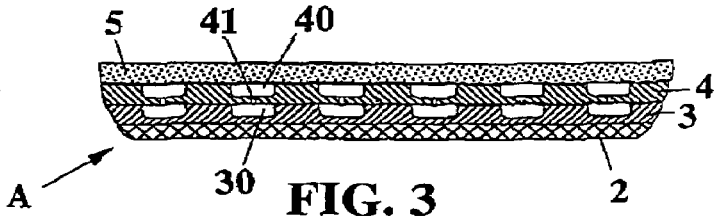
FIG. 3 represents a transversal cross-sectional view of a first solution for a stratified insole.

In terms of the insole A, which lies parallel in correspondence to the internal facade of the sole 1, it is observed that it can be anatomically shaped, can be of the stratified type and can be obtained as semi-finished by preliminarily assembling the different materials that form it according to an edging technique, sewing or adhering or simply by superimposing the single layers one on top of the other. In one solution, starting from the lower side, see FIG. 3, the insole A provides a first transpiring layer made up of a rigid or semi-rigid support 2, peripherally shaped according to the sole of the foot. Said first support 2 can be made from plastic material but also in natural materials such as bituminized felt, cork and others. A second layer 3 of material that does not conduct heat is joined to the rigid or semi-rigid support 2 in correspondence to the upper side. Also in this case, it concerns an element peripherally shaped according to the sole of the foot, which is obtained from a compound on a base of SEBS block copolymers (styrene-ethylene-butadiene-styrene) such as for example Bergaflex. Said second layer 3 is characterized, in correspondence with at least the upper facade, by the presence of certain channels 30 parallel and equidistant to each other, that extend longitudinally from the heel to the end of the toes. In terms of the lower side of said layer 3 it is substantially flat in order to be positioned close to the superior side of the first transpiring layer 2 that conventionally is also flat.

Figure 1:
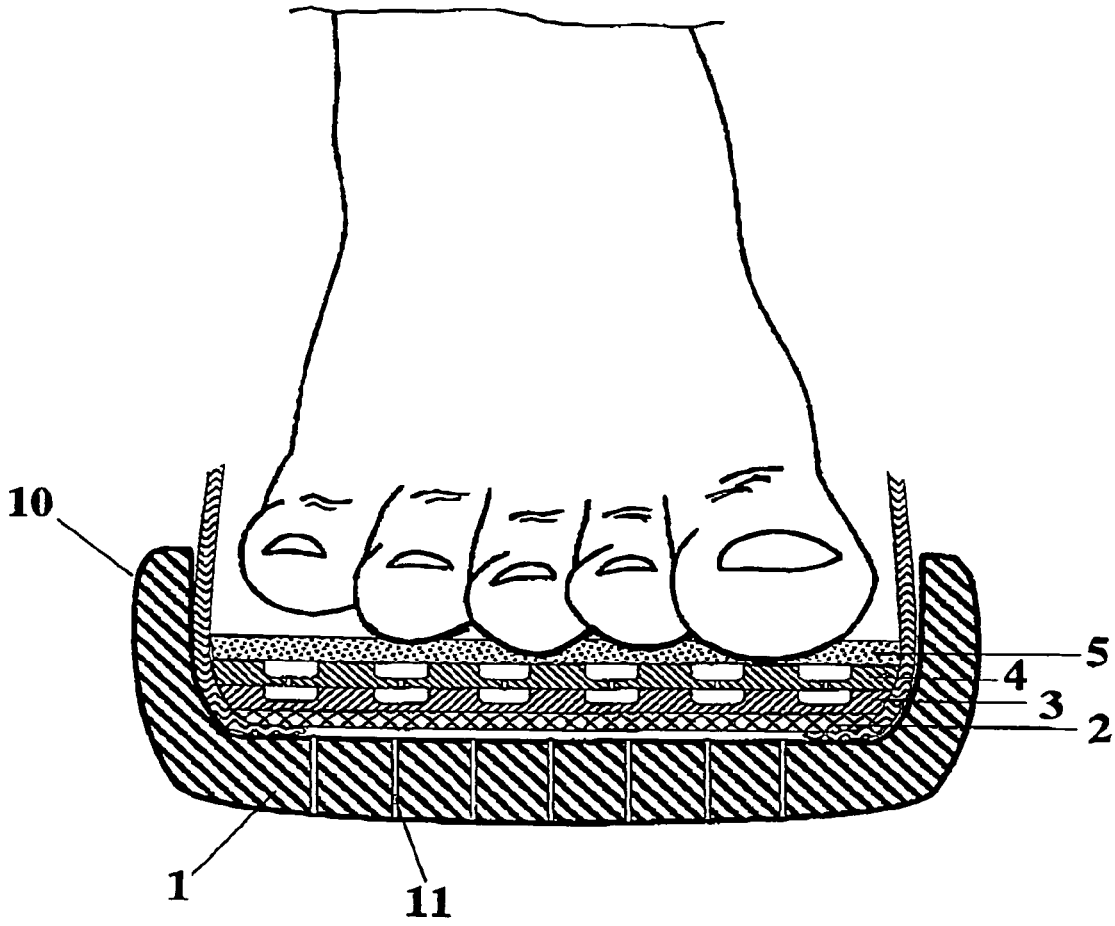
FIG. 1 represents a transversal cross-sectional view of the layered insole that is the object of this invention, integrated into a shoe.
Figure 5:
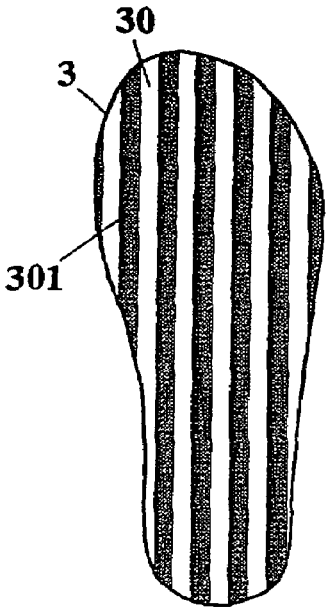
FIG. 5 represents a plan view of a layer of the stratified insole.
Figure 6:
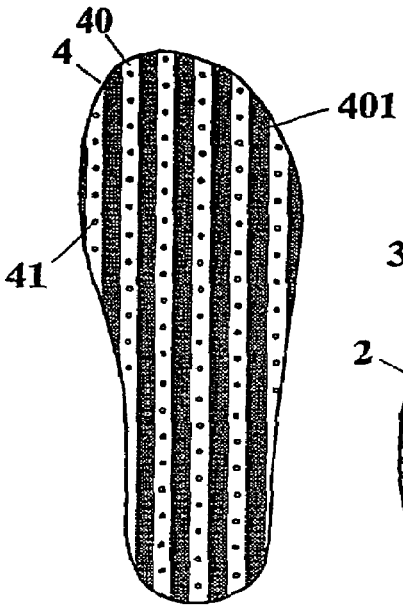
FIG. 6, represents a plan view of the layer to be superimposed on the layer in FIG. 5.
Figure 2:
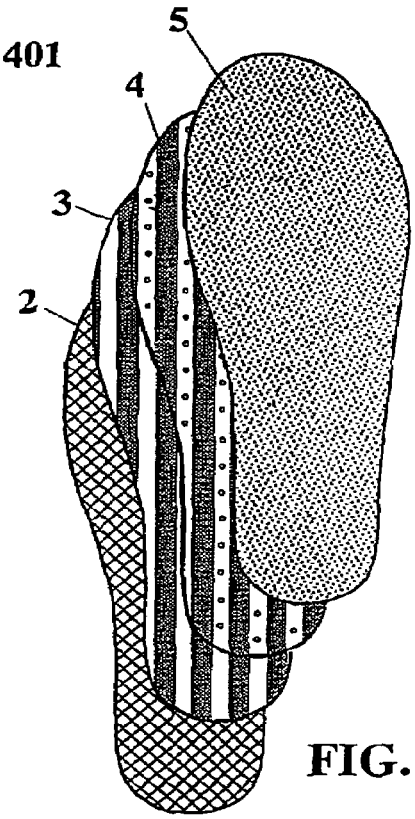
FIG. 2 represents a plan view of the layers of material to be superimposed and connected for the production of the stratified insole.
Figure 7:
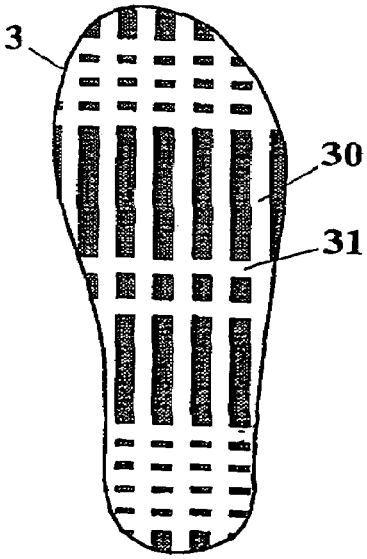
FIG. 7 is another plan view of the variant of the layer shown in FIG. 5.
Figure 4:
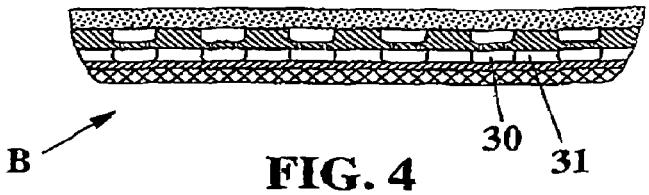
FIG. 4 represents a cross-sectional view of a stratified insole variant.

In one variant, see FIGS. 7 and 4, the insole B, instead of providing the second material layer 3 with only longitudinal channels 30, in addition it provides the latter with perpendicular channels 31, thus, orthogonal, oriented to transversely intersect the first channels, located in a more compact way in correspondence to the heel and the toe while in a looser way in the proximity of the arch.

Said second material layer 3 is to be joined to a third layer 4 made in the same material as the second 3 for example in Bergaflex, in correspondence to the upper side where the channels 30 and/or 31 are obtained. This third layer 4 presents the lower side, that will serve as a support in correspondence to the upper side of the second layer 3 that is flat while the upper side is analogously involved by a plurality of channels 40 that are parallel and equidistant and longitudinally extend from the heel area to that of the end of the toes. In this case, on the interior of the said channels 40, holes 41 are obtained, that being through holes, place the channels 30 and/or 31 of the underlying second layer 3 in communication with the channels 40 of said third layer of material. In this way the migration of the air from the second layer 3 to the third layer 4 is simplified. The stable union between said second and third layer, respectively 3 and 4, is carried out in way such that the holes 41 of the third layer 4 coincide at least partly and exactly with the position of the channels 30 and/or 31 of the underlying second layer 3. In this hypothesis, it is convenient that the position and the number of the longitudinal channels 30 obtained along the second layer 3, at least partly coincide with the channels 40 obtained in correspondence with the third layer 4.

Both in the second layer 3 and in the third material layer 4 the presence of the respective channels 30 and 40 produces a plurality of longitudinal ribs 301, 401 that separate each channel 30 and 40 from the adjacent channel. Therefore, the flat and lower side of the third layer 4 will serve as a support in correspondence with the upper side of each rib 301 of the second lower layer 3. In the same way a fourth layer of transpiring material 5, such as for example made of leather, will serve to support the lower side in correspondence with the upper side of each rib 401 of the third material layer 4.

I claim:

1. Stratified insole for a shoe of the type comprising a sole, if necessary provided with holes intercommunicating with the interior of the shoe, in correspondence with an interior side to which a ventilated stratified insole is joined that is comprised of at least one layer of thermoplastic material whose upper interface is shaped with a plurality of channels and is positioned above a layer of transpiring material to support the sole of the foot; said insole being peripherally shaped according to the shape of the sole of the foot, said insole comprising:

a first lower support layer comprised of transpiring material;

a second layer, superimposed on said first lower support layer, comprised of insulating material, which provides a plurality of channels in correspondence to the upper interface;

a third layer superimposed on said second layer, comprised of insulating material, which provides, in correspondence with the upper interface, a plurality of channels that at least partly coincide with the channels obtained along the second layer, said channels being in intercommunication with the channels of the second and underlying layer; and a fourth layer of material joined to said third layer, comprised of transpiring material.

2. Stratified insole for a shoe according to claim 1, characterized in that the second layer in correspondence with the upper interface disposes of channels that develop from the anterior part, corresponding to the toe area of the insole, to the posterior part corresponding to the heel area of said layer of material.

3. Stratified insole for a shoe according to claim 1, wherein the third layer in correspondence with the upper interface disposes of channels that develop longitudinally from the anterior part to the posterior part of said material layer and each of said channels is provided longitudinally with connecting holes between said channels and the channels of the second and underlying layer.

4. Stratified insole for a shoe according to claim 1, wherein the second layer provides channels that intersect the longitudinal channels obtained in correspondence to the upper interface of the second layer of material, said subsequent channels are located in a more compact way in correspondence to the heel and toe area while they are fitted more loosely in correspondence to the arch.

5. Stratified insole for a shoe according to claim 1, wherein at least the second layer of insulating material is obtained from a compound on a base of SEBS block copolymers (styrene-ethylene-butadiene-styrene).

6. Stratified insole for a shoe according to claim 1, wherein the third layer of insulating material connected to said second layer is obtained from a compound based on SEBS block copolymers (styrene-ethylene-butadiene-styrene).

7. Stratified insole for a shoe according to claim 1, wherein position and number of longitudinal channels obtained along the second layer coincide logically with the channels obtained in correspondence with the third layer.

* * * * *